US011116379B2

(12) United States Patent
Choi et al.

(10) Patent No.: US 11,116,379 B2
(45) Date of Patent: Sep. 14, 2021

(54) DISHWASHER

(71) Applicant: LG Electronics Inc., Seoul (KR)

(72) Inventors: Yongjin Choi, Seoul (KR); Shinwoo Han, Seoul (KR)

(73) Assignee: LG Electronics Inc., Seoul (KR)

( * ) Notice: Subject to any disclaimer, the term of this patent is extended or adjusted under 35 U.S.C. 154(b) by 12 days.

(21) Appl. No.: 16/323,189

(22) PCT Filed: Aug. 3, 2017

(86) PCT No.: PCT/KR2017/008422
§ 371 (c)(1),
(2) Date: Feb. 4, 2019

(87) PCT Pub. No.: WO2018/026226
PCT Pub. Date: Feb. 8, 2018

(65) Prior Publication Data

US 2019/0159651 A1 May 30, 2019

(30) Foreign Application Priority Data

Aug. 4, 2016 (KR) ..... 10-2016-0099559

(51) Int. Cl.
*A47L 15/42* (2006.01)
*A47L 15/00* (2006.01)
*B05B 1/00* (2006.01)

(52) U.S. Cl.
CPC ..... *A47L 15/0031* (2013.01); *A47L 15/00* (2013.01); *A47L 15/0039* (2013.01);
(Continued)

(58) Field of Classification Search
CPC .... A47L 15/00; A47L 15/0023; A47L 15/026; A47L 15/0028; A47L 15/0031;
(Continued)

(56) References Cited

U.S. PATENT DOCUMENTS 4,836,834 A 6/1989 Steele
2005/0005952 A1* 1/2005 Bashark ..... A47L 15/0023 134/18
2011/0226289 A1 9/2011 Forster

FOREIGN PATENT DOCUMENTS

JP 2008086868 4/2008
JP 2008119151 5/2008
(Continued)

OTHER PUBLICATIONS

Machine Translation of Nanbu et al., JP 2008-119151 A, May 2008. (Year: 2008).*
(Continued)

*Primary Examiner* — David G Cormier
(74) *Attorney, Agent, or Firm* — Fish & Richardson P.C.

(57) ABSTRACT

An air jet generator according to an embodiment of the present invention includes: an impeller which applies centrifugal force to washing water flowing in a forward direction; a decompression portion which decreases a pressure of the washing water that flows; an air suction portion which is opened to allow air to flow into the decompression portion; a pressing portion which increases pressure so as to crush the air introduced from the air suction portion; an air tap which has a plurality of holes so as to crush the air contained in the washing water that passed through the pressing portion; and
(Continued)

a reverse spray nozzle which sprays the washing water toward the air tap in a reverse direction.

16 Claims, 8 Drawing Sheets

(52) U.S. Cl.
CPC ..... *A47L 15/0049* (2013.01); *A47L 15/42* (2013.01); *A47L 15/4208* (2013.01); *A47L 15/4214* (2013.01); *B05B 1/002* (2018.08); *A47L 2401/07* (2013.01); *A47L 2401/30* (2013.01); *A47L 2501/20* (2013.01); *B05B 1/00* (2013.01)

(58) Field of Classification Search
CPC .. A47L 15/0039; A47L 15/0049; A47L 15/10; A47L 15/4208; A47L 15/4214; A47L 15/4219; A47L 15/4221; A47L 15/424; A47L 2401/07; A47L 2401/08; A47L 2401/30; A47L 2501/05; A47L 2501/20; B05B 1/00; B05B 1/002; A01K 63/042; C02F 3/1294; B01F 3/0876; B01F 5/0206; B01F 5/0268; B01F 5/0413; B01F 5/0415
See application file for complete search history.

(56) References Cited

FOREIGN PATENT DOCUMENTS

| | | |
|---|---|---|
| JP | 5794338 | 10/2015 |
| KR | 1020120052728 | 5/2012 |

OTHER PUBLICATIONS

Machine Translation of Sakatani et al., JP 2008-086868 A, Apr. 2008. (Year: 2008).*
Australian Office Action in Australian Application No. 2017307903, dated Jul. 29, 2019, 5 pages.

* cited by examiner

DISHWASHER

CROSS-REFERENCE TO RELATED APPLICATIONS

This application is a National Stage application under 35 U.S.C. § 371 of International Application No. PCT/KR2017/008422, filed on Aug. 3, 2017, which claims the benefit of Korean Application No. 10-2016-0099559, filed on Aug. 4, 2016. The disclosures of the prior applications are incorporated by reference in their entirety.

TECHNICAL FIELD

The present invention relates to a dishwasher, and more particularly, to a dishwasher including an air jet generator for generating an air bubble therein.

BACKGROUND ART

A dishwasher is a household appliance that removes foreign matter remaining on a cleaning target object by spraying washing water on the cleaning target object. The dishwasher sprays washing water to the cleaning target object accommodated in a rack according to a cleaning course selected by a user to remove the dirt from the cleaning target object.

As a method for effectively removing foreign matter adhered to the dishes, a method of using a detergent having a strong cleaning ability, a method of increasing the spraying pressure of the washing water can be utilized, or a method of containing an air bubble in the washing water may be utilized.

The washing water containing the air bubble generates free radicals having excellent sterilizing power and chemical decomposing ability while the air bubble is dissipated, thereby effectively removing foreign matter adhered to the dishes.

However, in the air bubble, as the size of the bubble becomes smaller, the total interfacial area becomes larger, the surfacing speed becomes slower, and internal pressure becomes larger, thereby having an excellent adsorption of hydrophobic molecule, and increasing the availability of gas.

Therefore, when a large amount of air bubbles having a minute size are contained in the washing water, a large effect can be obtained for washing the dishes.

In order to form a minute size air bubble, washing water containing air bubbles may be passed through an apparatus having a plurality of holes, but the use of such an apparatus may cause the problem that a plurality of holes are clogged by foreign matter flowing with the washing water.

DISCLOSURE

Technical Problem

It is an object of the present invention to provide a dishwasher including an air tap provided with a plurality of holes for forming air bubbles of minute size, while including a separate apparatus for removing foreign matter when foreign matter is clogged in the air tap.

It is an object of the present invention to provide a dishwasher which can remove foreign matter clogged in the air tap during operation of an air jet generator for generating air bubbles.

It is an object of the present invention to provide a dishwasher which proceeds a process of removing foreign matter only when foreign matter is clogged in the air tap.

It is an object of the present invention to provide a dishwasher which forms air bubbles in washing water by using a conventional pump for dishwashing without a separate pump for supplying washing water to an air jet generator for forming air bubbles.

It is an object of the present invention to provide a dishwasher which generates air bubbles of minute size by crushing the air bubbles formed in the washing water to the utmost to produce bubbles.

The problems of the present invention are not limited to the above-mentioned problems, and other problems not mentioned can be clearly understood by those skilled in the art from the following description.

Technical Solution

In an aspect, there is provided a dishwasher, including: a tub which accommodates dishes; a spray module which sprays washing water toward the dishes in the tub; a sump which supplies the washing water to the spray module; a pump which pumps the washing water stored in the sump to the spray module; and an air jet generator which receives a part of the washing water pumped from the pump to form an air bubble in the washing water and discharges the air bubble to the sump, wherein the air jet generator includes: a decompression portion which decreases a pressure of the washing water that flows; an air suction portion which is opened to allow air to flow into the decompression portion; a pressing portion which increases pressure so as to crush the air introduced from the air suction portion; an air tap which has a plurality of holes so as to crush the air contained in the washing water that passed through the pressing portion; and a reverse spray nozzle which sprays the washing water toward the air tap in a reverse direction.

The air jet generator comprises an impeller which applies centrifugal force to the washing water flowing in a forward direction, so that water flow can be formed in the washing water flowing to the decompression portion.

The washing water sprayed in a reverse direction from the reverse spray nozzle flows into the air suction portion, the air tap is disposed between the air suction portion and the reverse spray nozzle, so that the foreign matter clogged in the air tap can be discharged to the air suction portion.

The pressure of the washing water sprayed in a reverse direction from the reverse spray nozzle is higher than the pressure of washing water flowing in a forward direction for the air tap, so that the foreign matter clogged in the air tap can be removed in the process of flowing the washing water forming the air bubble.

A shape of a plurality of holes formed in the air tap is formed to be a slot type hole shape which is elongated in a left and right direction, so that the air tap maintains a proper rigidity and the sucked air can be crushed well.

The spray module includes a plurality of spray nozzles which spray the washing water toward the dishes, the dishwasher further includes a vario chamber which selectively supplies the washing water to the spray module, wherein the vario chamber supplies some flow to the reverse spray nozzle, thereby removing the foreign matter clogged inside the air jet generator by using a conventional dishwasher structure.

The dishwasher further includes a connection flow path which supplies the washing water to the vario chamber and the reverse spray nozzle; and a control valve which opens and closes the connection flow path.

The pump includes a motor which drives the pump; and a current measuring unit which measures a current in the motor, wherein the current measuring unit detects variation of a load measured in the motor and opens/closes the control valve, thereby detecting the clogging of the foreign matter in the air tap.

In another aspect, there is provided a method of controlling a dishwasher, including the steps of: a normal operation step of injecting air into washing water flowing in a forward direction and passing an air tap to generate an air bubble in the washing water; an air tap clogging detecting step of detecting clogging of the air tap; and a reverse spray step of spraying the washing water in a reverse direction from a reverse spray nozzle, when the clogging of the air tap is detected.

The air tap clogging detecting step includes detecting whether the air tap is clogged by variation of a load detected by a current measurement of a motor operating in a pump that supplies the washing water in a forward direction, thereby detecting whether foreign matter is clogged in the air tap during the operation of the pump.

The details of other embodiments are included in the detailed description and drawings.

Advantageous Effects

According to the air jet generator of the dishwasher of the present invention, one or more of the following effects can be obtained.

First, the dishwasher of the present invention includes a reverse spray nozzle for spraying washing water toward an air tap disposed in a reverse direction opposite to the flow direction of the washing water in which air bubbles are generated. Accordingly, there is an advantage that the foreign matter clogged in the air tap can be removed, and air bubbles can be smoothly formed.

Second, in the dishwasher of the present invention, the pressure of the washing water sprayed in the reverse direction from the reverse spray nozzle is set to be higher than the pressure of the washing water flowing in the forward direction for the air tap. Accordingly, there is an advantage that the foreign matter clogged in the air tap can be removed without stopping the air jet generator that forms air bubbles.

Third, there is an advantage that the clogging of the air tap can be detected by detecting the change of the load of the motor and the washing water is sprayed to the reverse spray nozzle when air clogging is detected, thereby complementing the function of the air jet generator.

Fourthly, the air jet generator of the dishwasher according to the present embodiment divides a part of the washing water supplied from the pump and generates air bubbles in the washing water through the branched flow. Accordingly, there is an advantage that, when the pump of the dishwasher is operated for washing dishes, air bubbles occur continuously.

Fifth, there is an advantage that air bubbles can be generated at a low pressure by using a pump disposed inside a conventional dishwasher, without using a separate pump.

Sixth, there is an advantage that some of the flow branched from the pump rotates along an impeller vane, sucks and crushes air along the air crushing pipe, and passes through the air tap, thereby maximizing the amount of air bubbles.

The effects of the present invention are not limited to the effects mentioned above, and other effects not mentioned can be clearly understood by those skilled in the art from the description of the claims.

MODE FOR INVENTION

Figure 1:
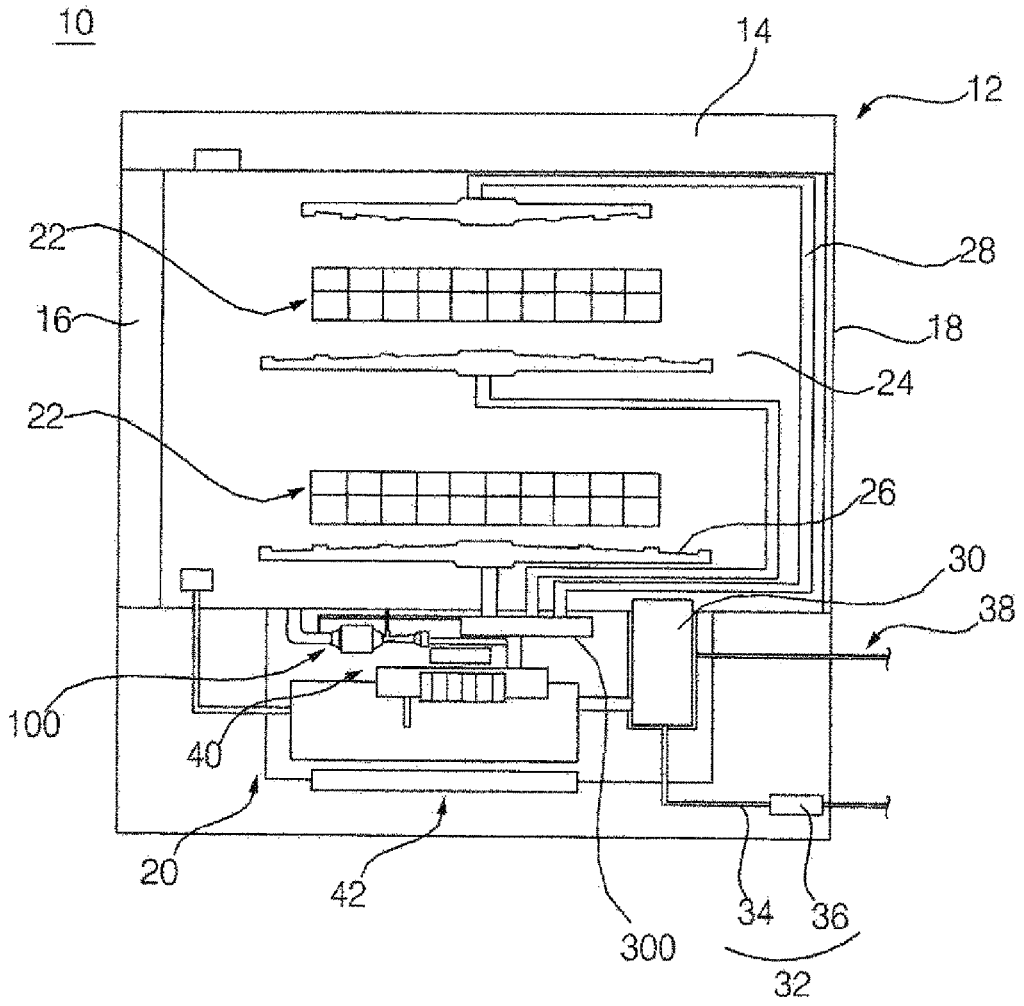
FIG. 1 is a schematic front cross-sectional view of a dishwasher according to an embodiment of the present invention.

Hereinafter, preferred embodiments of the present invention will be described with reference to the accompanying drawings. In describing the present embodiment, the same designations and the same reference numerals are used for the same components, and further description thereof will be omitted.

Hereinafter, an air jet generator of a dishwasher according to embodiments of the present invention will be described with reference to the drawings.

FIG. 1 is a schematic front cross-sectional view of a dishwasher according to an embodiment of the present invention.

Referring to FIG. 1, the dishwasher 10 according to the present embodiment includes a cabinet assembly 12 which forms an outer shape, a rack 22 which is disposed inside the cabinet assembly 12 and on which the dishes are placed, a spray module 24 which is disposed inside the cabinet assembly 12 and sprays washing water toward the dishes, a sump 20 which is disposed inside the cabinet assembly 12 and supplies washing water to the spray module 24, a water supply module 38 which supplies water to the sump 20 or the spray module 24, a discharge module 32 which is connected to the sump 20 and discharges the washing water to the outside, and a filter assembly 30 which is installed in the sump 20 and filters the washing water. In addition, the dishwasher 10 may further include a heater module 42 which is installed in the sump 20 and heats the washing water.

The cabinet assembly 12 forms an outer shape of the dishwasher, and includes a cabinet 14, a door 16 coupled to the cabinet 14 for opening and closing the cabinet 14, and a tub 18 which is installed inside the cabinet 14 and to which washing water or steam is applied, The rack 22 is installed inside the tub 18, and the dishes are placed on the rack 22.

The spray module 24 is implemented to spray washing water toward the dishes. The spray module 24 includes a spray nozzle 26 and a nozzle flow path 28 for supplying washing water to the spray nozzle 26.

A plurality of spray nozzles 26 may be disposed, a plurality of nozzle flow paths 28 corresponding to the spray nozzle 26 are disposed, and a vario chamber 300 for selectively supplying washing water to the spray module 24 and the nozzle flow path 28 is disposed.

The vario chamber 300 supplies washing water to the reverse spray nozzle 330 (see FIG. 4) of the air jet generator 100, which will be described below, as well as to the nozzle flow path 28. In the present embodiment, the spray module 24 is configured to spray the washing water after receiving the washing water from the sump 20 in which the washing water is stored. However, unlike the present embodiment, water may be directly received through the water supply module 38.

The water supply module 38 is configured to receive water from the outside and supply the water to the sump 20. In the present embodiment, water is supplied to the sump 20 through the filter assembly 30.

The discharge module 32 is implemented to discharge the washing water stored in the sump 20 to the outside, and includes a drainage flow path 34 and a drainage pump 36.

The filter assembly 30 is implemented to filter foreign matter such as food waste contained in the washing water, and is disposed in a flow path of the washing water flowing from the tub 18 into the sump 20.

To this end, the sump 20 may be provided with a filter mounting portion where the filter assembly 30 is installed, and a filter flow path connecting the filter mounting portion and the inside of the sump 20 may be disposed.

The sump 20 is provided with a sump storing portion for storing the washing water therein, and further includes a pump 40 for pumping the stored washing water to the spray module 24.

The pump 40 pumps the washing water stored in the sump 20 to the spray module 24 by the operation of a motor (not shown). A current measuring unit (not shown) is connected to the motor to measure the load variation of the motor. The pump 40 is connected to the spray module 24 through a pump flow path.

The pump 40 according to the present embodiment supplies the washing water to the air jet generator 100 in addition to the spray module 24 through a branch pipe 230. The air jet generator 100 is supplied with washing water through a flow path branched from the pump, and sucks gas into the supplied washing water through an air suction portion 140 and crushes the washing water to generate minute air bubbles. The air jet generator 100 is connected to the tub 18 or the sump 20. Therefore, when the pump is operated, the washing water having the air bubbles generated in the air jet generator 100 is supplied into the sump 20, and the washing water containing the air bubbles in the sump 20 is pumped to the spray module 24.

The air suction portion 140 (see FIGS. 3 and 4) of the air jet generator 100, which will be described below, is connected to the tub 18. The air jet generator 100 sucks air in the tub 18 through the air suction portion 140. However, when the washing water is sprayed from the reverse spray nozzle 330, the washing water flows into the air suction portion 140 and is discharged to the tub 18.

The sump 20 is connected to a steam flow path and a steam nozzle that spray the steam generated by the heater module 42 into the tub 18. A valve (not shown) for intermitting steam may be installed in the steam flow path. Through the valve, the steam sprayed into the tub 18 may be intermitted and the amount of steam may be adjusted upon occasions.

Here, the steam generated in the sump 20 may be supplied into the tub 18 through the filter flow path and the filter mounting portion, not through the steam nozzle. The sump 20 may be connected to the tub 18 in both directions through the steam flow path and the filter flow path.

Figure 2:
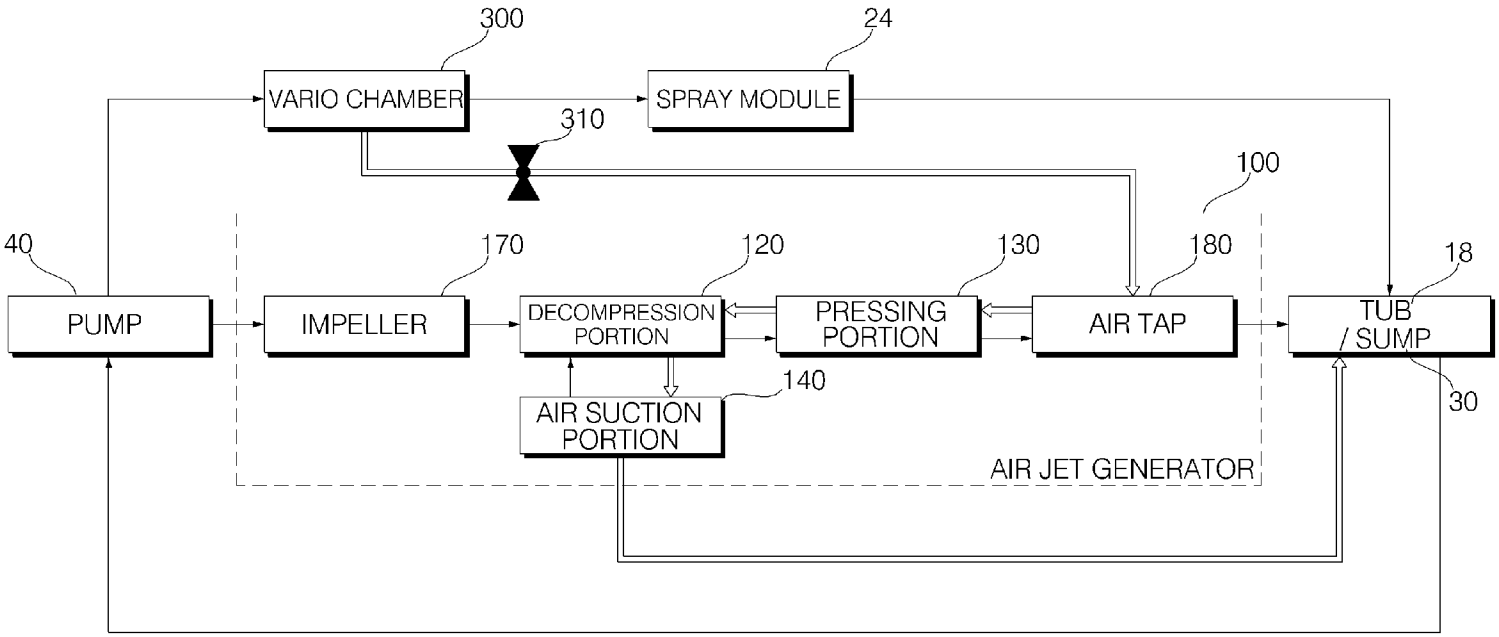
FIG. 2 is a block diagram showing a flow of washing water in a dishwasher including an air jet generator according to an embodiment of the present invention.
Figure 3:
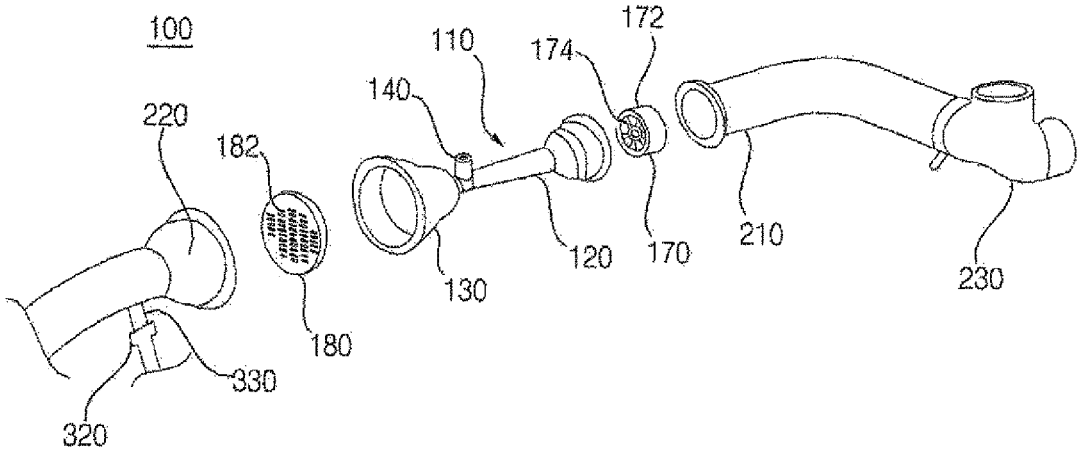
FIG. 3 is an exploded perspective view of an air jet generator according to the present embodiment.
Figure 4:
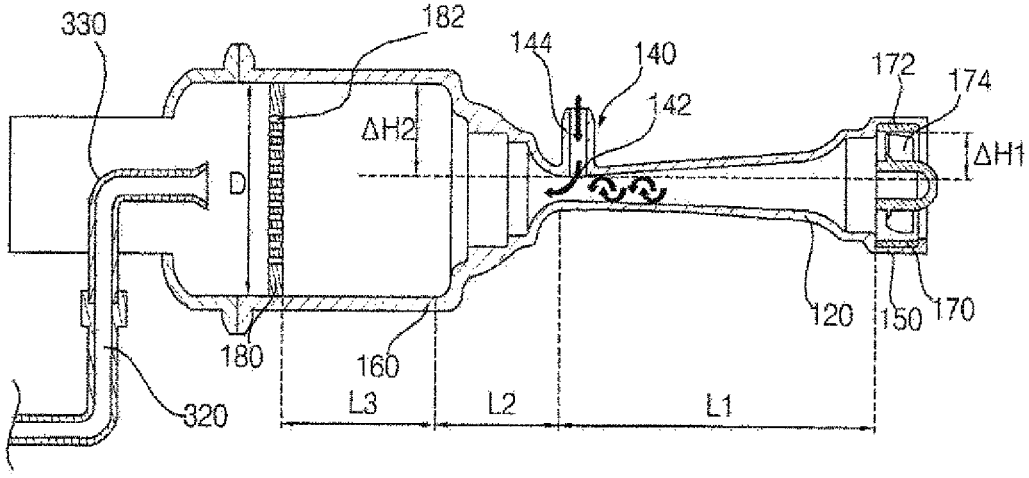
FIG. 4 is a side cross-sectional view for explaining the internal flow path of an air jet generator and a discharge pipe including a reverse spray nozzle according to the present embodiment.
Figure 5:
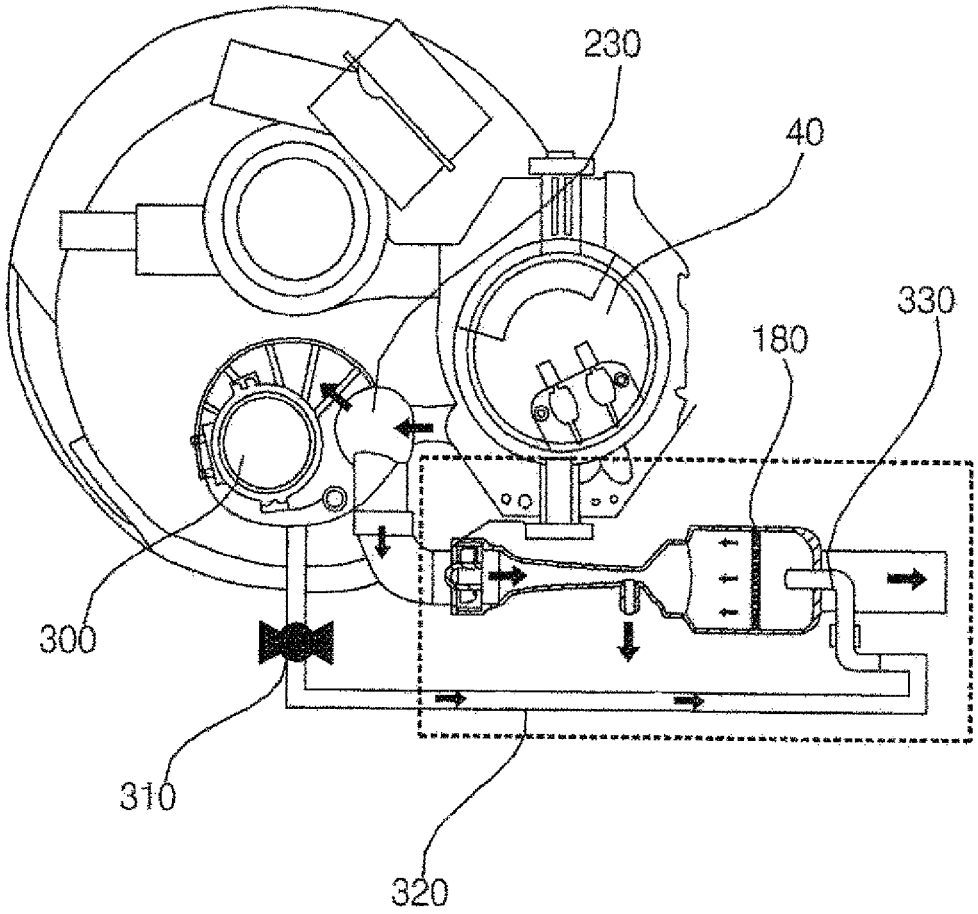
FIG. 5 is a diagram for explaining the connection relationship of an air jet generator, a reverse spray nozzle, a vario chamber, and a pump according to the present embodiment.
Figure 6A:
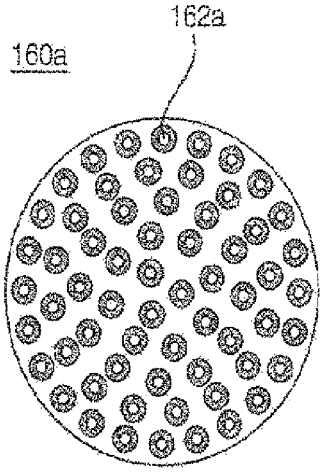
FIG. 6A is a front view of an air tap having a hollowed type hole according to an embodiment of the present invention.
Figure 6B:
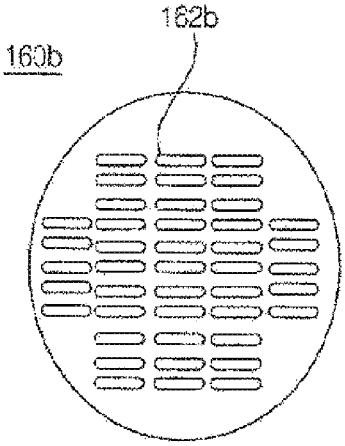
FIG. 6B is a front view of an air tap having a slot type hole according to another embodiment of the present invention.
Figure 6C:
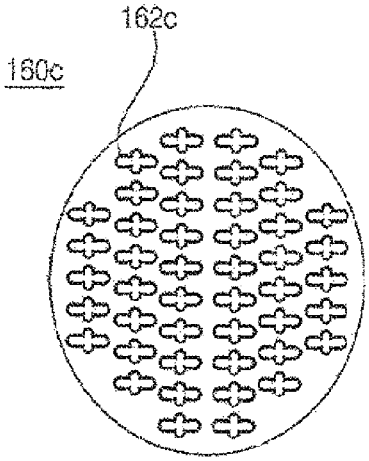
FIG. 6C is a front view of an air tap having a cross slot type hole according to another embodiment of the present invention.
Figure 7A:
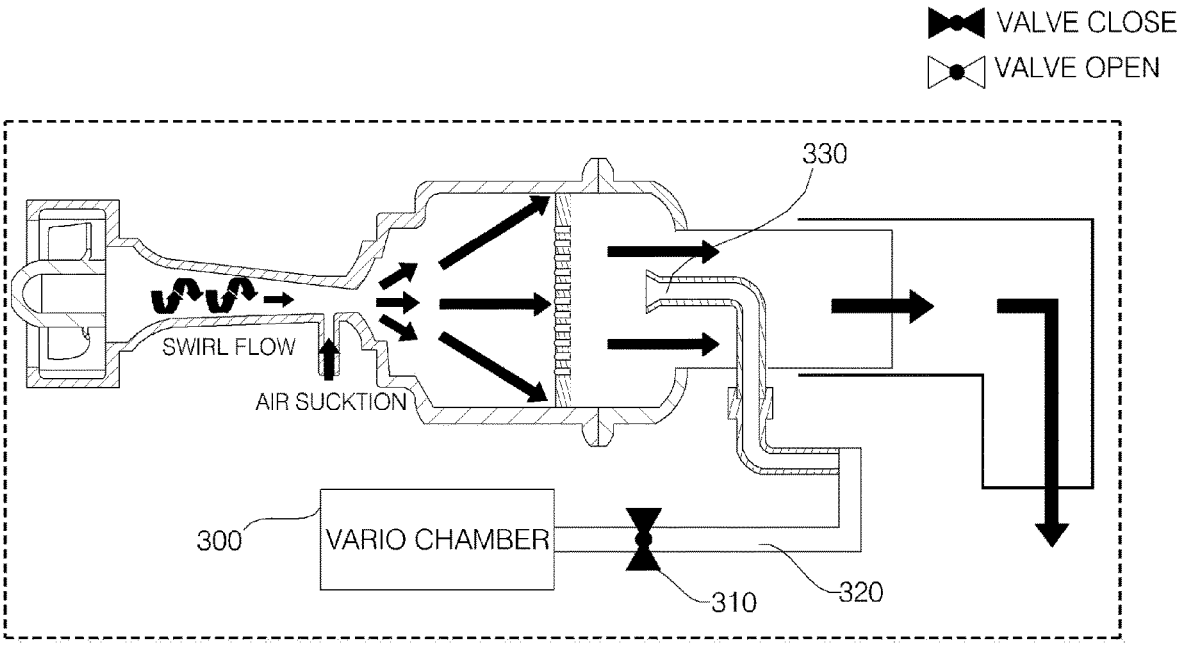
FIG. 7A is a diagram for explaining the flow of washing water inside an air jet generator when washing water is not sprayed from a reverse spray nozzle.
Figure 8:
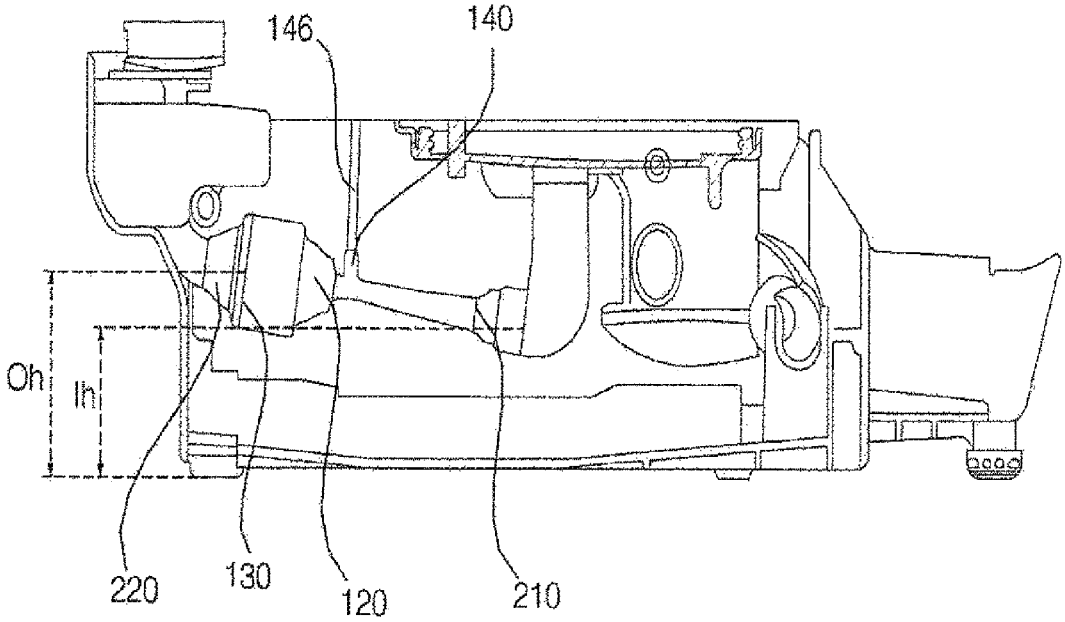
FIG. 8 is a diagram for explaining a side disposition of an air jet generator according to the present embodiment.

FIG. 2 is a block diagram showing a flow of washing water in a dishwasher including an air jet generator according to an embodiment of the present invention. FIG. 3 is an exploded perspective view of an air jet generator according to the present embodiment. FIG. 4 is a side cross-sectional view for explaining the internal flow path of an air jet generator and a discharge pipe including a reverse spray nozzle according to the present embodiment. FIG. 5 is a diagram for explaining the connection relationship of an air jet generator, a reverse spray nozzle, a vario chamber, and a pump according to the present embodiment. FIG. 6 is a front view of an air tap having various types of holes according to an embodiment of the present invention. FIG. 7A is a diagram for explaining the flow of washing water inside an air jet generator, when washing water is not sprayed from a reverse spray nozzle, and sprayed from a reverse spray nozzle. FIG. 8 is a diagram for explaining a side disposition of an air jet generator according to the present embodiment.

Referring to FIG. 2, the flow of washing water is described.

The flow of the washing water in the air jet generator 100 may be divided into a case where the washing water is not sprayed from the reverse spray nozzle and a case where the washing water is sprayed from the reverse spray nozzle. When the washing water is not sprayed from the reverse spray nozzle, a part of the washing water stored in the sump flows to the air jet generator 100 to form air bubbles in the washing water.

In the case where the washing water is not sprayed from the reverse spray nozzle, the washing water stored in the sump 20 of the dishwasher 10 is supplied to the spray module 24 through the pump 40 and then flows into the sump 20 again through the tub 18. The dishwasher 10 according to the present embodiment flows into the air jet generator 100 in which a part of the washing water that passed through the pump 40 generates air bubbles in the washing water.

The air jet generator 100 is supplied with a part of the washing water discharged from the pump 40. The air jet generator 100 sequentially passes the introduced washing water through an impeller 170, a decompression portion 120, a pressing portion 130, and the air tap 180. The decompression portion 120 is provided with the air suction portion 140 formed at a portion where the decompression is terminated so that outside air is introduced into the decompression portion 120. The introduced air, together with the washing water, passes through the pressing portion 130 and the air tap 180 to form air bubbles of minute size.

In this case, a flow in which the washing water sequentially passes through the impeller 170, the decompression portion 120, the pressing portion 130, and the air tap 180 of the air jet generator 100 is referred to as forward flow, and a flow opposite to this flow is referred to as reverse flow. This is intended to describe the washing water flowing in the air jet generator 100 and the configuration of the air jet generator 100, and does not limit the scope of the invention.

The wash water containing the air bubbles flows into the sump 20 again. The washing water containing the air bubbles may be introduced into the sump 20 through the tub 18. When the pump 40 is operated by the operation of the dishwasher 10, air bubbles are formed in the washing water.

Next, a case in which washing water is sprayed from the reverse spray nozzle will be described. When the foreign matter is clogged in the air tap 180 and the washing water does not flow smoothly to the air jet generator 100, the vario chamber 300 sprays washing water into the reverse spray nozzle 330 to remove the foreign matter clogged in the air tap 180. The vario chamber 300 and the reverse spray nozzle 330 are connected to a connection flow path 320, and a control valve provided in the connection flow path 320 is opened to spray the washing water to the reverse spray nozzle 330.

The reverse spray nozzle 330 sprays the washing water in the reverse direction toward the air tap 180. The washing water sprayed from the reverse spray nozzle 330 is sprayed at a higher pressure than the washing water flowing in the forward direction and passes through the air tap 180.

The washing water, together with the foreign matter clogged in the air tap 180, sprayed from the reverse spray nozzle 330 flows into the air suction portion 140 and is discharged to the tub. The foreign matter discharged to the tub may be discharged in the next process of the dishwasher 10.

Referring to FIGS. 3 to 8, the air jet generator 100 according to the present embodiment will be described.

The air jet generator 100 according to the present embodiment includes the impeller 170 for applying centrifugal force to the washing water that flows in the forward direction, the decompression portion 120 for reducing the pressure of the washing water that passed through the impeller, the air suction portion 140 for injecting air into the decompression portion, the pressing portion 130 for increasing a pressure to crush the air introduced from the air suction portion, the air tap 180 having a plurality of holes for crushing the air contained in the washing water passed through the pressing portion, and the reverse spray nozzle 330 for spraying washing water in the reverse direction toward the air tap 180.

The air suction portion 140 receives the washing water sprayed in the reverse direction from the reverse spray nozzle 330.

The decompression portion 120 has a cross-sectional area of the flow path that is decreased in the traveling direction of the washing water. The pressing portion 130 is formed in such a manner that the rate of increase in the cross-section of the flow path per flow path length is larger than the rate of decrease in the cross-section of the flow path per flow path length of the decompression portion. The air suction portion 140 is disposed in a portion where the flow path area of the decompression portion 120 is decreased.

The decompression portion 120 and the pressing portion 130 form a single air crushing pipe 110.

The air jet generator 100 is connected to an inflow pipe 210 for allowing a part of the washing water passed through the pump 40 to flow to the air crushing pipe 110, and is connected to a discharge pipe 220 for discharging the washing water passed through the air crushing pipe 110.

The inflow pipe 210 is connected to the air crushing pipe 110 and sends part of the washing water discharged from the pump 40 to the air crushing pipe 110. The discharge pipe 220 connects the air crushing pipe 110 and the sump 20 or the tub 18 to flow the washing water discharged from the air crushing pipe 110 to the sump 20 or the tub 18.

The reverse spray nozzle 330 is disposed inside the discharge pipe 220. The reverse spray nozzle 330 is opened in the direction of the air tap 180 inside the discharge pipe 220.

An inflow end surface 112 of the air crushing pipe 110 and an end surface of the inflow pipe 210 are coupled to each other in a fusing manner at a portion where they are in contact with each other. A discharge end surface 114 of the air crushing pipe 110 and the end surface of the discharge pipe 220 are coupled to each other in a fusing manner at a portion where they are in contact with each other.

Referring to FIG. 3 and FIG. 4 the impeller 170 is mounted in an impeller mounting portion 150 which forms a space in which the impeller 170 is disposed at an opening portion to which the washing water of the air crushing pipe 110 is introduced.

The impeller 170 is disposed before the decompression portion 120 of the air crushing pipe 110 in the direction in which the washing water flows. Thus, the impeller 170 is not mounted in the impeller mounting portion 150 of the air crushing pipe 110 but may be disposed inside the inflow pipe 210 or between the decompression portion 120 and the inflow pipe 210.

The impeller 170 according to the present embodiment is mounted and fixed to the impeller mounting portion 150. The impeller 170 includes an impeller circumferential portion 172 having an annular outer shape and a vane 174 disposed inside the impeller circumferential portion 172 to apply centrifugal force to the washing water. The impeller circumferential portion 172 abuts against the impeller mounting portion 150 and is fixed.

The washing water passed through the impeller 170 rotates as it passes through the vane 174 to generate a swirling flow. The vane 174 of the impeller 170 applies a centrifugal force to the washing water flowing to the decompression portion 120. The vane 174 of the impeller 170 may be fixed or rotated and applies centrifugal force to the washing water passing through the impeller 170.

The air crushing pipe 110 includes the decompression portion 120 for decompressing the washing water and increasing the speed of the washing water and the pressing portion 130 in which the cross-sectional area of the flow path is drastically increased. The decompression portion 120 is provided with an air suction portion 140 which sucks air from a portion where the washing water is decompressed to form a negative pressure.

The air crushing pipe 110 further includes the impeller mounting portion 150 in which the impeller 170 is mounted and an air tap mounting portion 160 in which the air tap 180 is mounted.

The air crushing pipe 110 is disposed in the order of the impeller mounting portion 150, the decompression portion, the pressing portion, and the air tap mounting portion 160 in the direction in which the washing water flows in the forward direction. The air suction portion 140 is formed at a portion where the flow path cross-sectional area of the decompression portion 120 is reduced. The air suction portion 140 forms a suction port opened upward at a portion where the decompression of the decompression portion 120 is terminated.

The impeller mounting portion 150 is connected to the end of the inflow pipe 210, and the inner circumference of the impeller mounting portion 150 is formed to correspond to the outer circumference of the impeller circumferential portion 172 such that the impeller 170 is mounted and fixed to the impeller mounting portion 150.

The decompression portion 120 is disposed in the next position of the impeller mounting portion 150 of the air crushing pipe 110 in the direction in which the washing water flows. The decompression portion 120 is a part of the air crushing pipe 110 through which the washing water that passed through the impeller 170 flows. In the decompression portion 120, the cross sectional area of the flow path is decreased in the progress direction of the washing water such that the pressure of the washing water flowing through the decompression portion 120 is decreased and the speed is increased.

In the decompression portion 120, the cross section of the flow path is gradually decreased in the progress direction of the washing water.

The decompression portion 120 forms the air suction portion 140 at a portion where decompression is terminated. The air suction portion 140 is formed at a portion where the flow path cross-section of the decompression portion 120 is decreased. The air suction portion 140 forms an air suction port 142 opened toward the upper side of the dishwasher opposite to the ground to prevent the water from flowing toward the air suction portion and being accumulated even if the pump does not operate.

The air suction portion 140 forms the air suction port 142 opened upward from one side of the decompression portion 120. The air suction portion 140 includes an air suction pipe 144 protruding from one side of the decompression portion 120 to form a flow path through which air is sucked therein. The air suction pipe 144 sucks air in the tub 18. The air suction pipe 144 is connected to the tub 18 by a tub connection flow path 146.

However, when the washing water is sprayed to the reverse spray nozzle 330, the washing water flows into the air suction portion 140, and the washing water is discharged to the tub 18 through the tub connection flow path 146.

The tub connection flow path 146 is coupled to the air suction pipe 144 in a fusing method. The air suction pipe 144 may be integrally formed with the tub connection flow path 146 and directly connected to the outside of the dishwasher 10 or to the tub 18.

In the decompression portion 120, the area of the flow path is decreased toward the progress direction of the washing water so that the pressure of the washing water is lowered, and a negative pressure lower than the atmospheric pressure is formed at a portion where the suction port 42 of the air suction portion 140 is formed such that the outside air is sucked in by itself. The air sucked into the air crushing pipe 110 is primarily crushed by the speed and the swirling force of the washing water flowing inside the decompression portion 120.

The washing water containing the primarily crushed air flows to the pressing portion 130.

The pressing portion 130 is disposed in the next part of the decompression portion 120 of the air crushing pipe 110 in the direction in which the washing water flows. The pressing portion 130 receives the washing water that passed through the decompression portion 120.

The pressing portion 130 increases the pressure to such an extent that the air introduced from the air suction portion 140 is crushed. In the pressing portion 130, the cross-sectional area of the flow path is rapidly increased in the direction in which the washing water flows so that the air contained in the washing water can be crushed. The increasing ratio ($\Delta H2/L2$) of the radius of the flow path cross section per flow path length of the pressing portion 130 is larger than the decreasing ratio ($\Delta H1/L1$) of the radius of the flow path cross section per flow path length of the decompression portion.

The flow path cross-sectional area of a discharge end portion of the pressing portion 130 is formed wider than the flow path cross-sectional area of an inflow end portion of the decompression portion 120. The pressing portion 130 expands larger than the flow path cross-section of the inflow pipe 210 so that the air crushing through a pressure difference occurs effectively.

As the cross-sectional area of the flow path rapidly increases, the speed of the washing water decreases, and the pressure rapidly increases. Due to a sudden increase in pressure, the air in the washing water is secondarily crushed.

In the direction in which the washing water flows, a side end surface of the flow path of the pressing portion 130 increases like a curved line of a quadratic function, and then, is bent in a stepped shape and a side end surface of the flow path is widened. Since the cross section of the flow path of the pressing portion 130 is gradually expanded in a narrow section, air crushing in the washing water through the pressure difference effectively proceeds.

The air tap mounting portion 160 is disposed in the next position of the pressing portion 130 of the air crushing pipe 110 in the direction in which the washing water flows. The air tap mounting portion 160 maintains a constant flow path extended from the pressing portion 130, and the air tap 180 is mounted inside the air tap mounting portion 160.

The air tap 180 is mounted in the air tap mounting portion 160 of the air crushing pipe 110. The air tap 180 is disposed between the air suction portion 140 and the reverse spray nozzle. The air tap 180 is fixed to the air tap mounting portion 160. The air tap 180 is disposed at a position spaced apart from the pressing portion 130 by a certain distance.

The air tap 180 has a disk shape, and is provided with a plurality of holes 182 penetrating the inside thereof. The washing water passed through the pressing portion 130 passes through the air tap. The air in the washing water is thirdly crushed while passing through the plurality of holes 182 formed in the air tap 180.

The holes 182 formed in the air tab 180 are disposed closely to the disk-shaped air tab 180 at regular intervals. The air tap 180 may be an air tap 180*a* having a hollowed type hole 182*a* as shown in FIG. 6A or an air tap 180*b* having a slot type hole 182*b* elongated in the left and right direction as shown in FIG. 6B. In addition, as shown in FIG. 6C, it may be an air tap 180*c* having a cross slot type hole 182*c* in which an elliptical shape elongated in the vertical direction and an elliptical shape elongated in the left and right direction are combined.

In the hole 182 formed in the air tap 180, as the contact area with the air bubble increases, the shearing force acting on the air bubble increases to increase the amount of generated air bubbles. Thus, the slot type hole is preferable to the hollowed type hole. However, when the size of the hole is excessively increased as in the case of the cross slot type, the air tap may have a reliability problem. Thus, it is preferable that the air tap has a slot type hole.

When the hole of the air tap 180 having the slot type hole is elongated in the left and right direction, and the ratio of the vertical height to the horizontal length of the slot type hole 182*b* is 1:4 to 6, the amount of generated air bubbles increases, and it is also suitable for the reliability of the air tap. Thus, it is preferable that the ratio of the height to the horizontal length of the slot type hole 182*b* is 1:4 to 6.

As the washing water passes through the pressing portion 130, the sucked air is secondarily crushed. The air tap 180 is spaced apart from the pressing portion 130 at a predetermined interval. When the air tab 180 is spaced from the pressing portion 130 at regular intervals, the sucked air is sufficiently secondarily crushed through the pressing portion 130, and then, passes through the air tap 180 again, thereby increasing the amount of generated air bubbles. Therefore, it is preferable that the distance L3 of the air tap 180 spaced from the pressing portion 130 maintains a distance of the diameter size D or more of the cross section of the air tap so as to maximize the amount of generated air bubbles.

As the thickness of the air tap 180 becomes thinner, the possibility of clogging due to foreign matter is lowered, and there is an advantage that mass production is easy. Since the effect of crushing the air is not significantly different depending on the thickness of the air tap 180, it is preferable that the thickness of the air tab is manufactured with a thickness ranging from 2 to 5 mm.

The discharge pipe 220 has a shape in which a side end surface of the flow path is reduced at a portion where the washing water is introduced. In the discharge end of the air crushing pipe 110, the flow path is expanded for the air crushing, and the discharge pipe 220 has a shape in which a side end surface of the flow path is reduced at a portion where the washing water is introduced, in order to reduce the size of the flow path volume of the discharge pipe 220 connected to the tub 18 or the sump 20.

The reverse spray nozzle 330 is disposed inside the discharge pipe 220. The reverse spray nozzle 330 passes through one side of the discharge pipe 220 and is connected to the vario chamber 300 through the connection flow path 320. The reverse spray nozzle 330 forms an opening which is opened in the direction of the air tap 180 inside the discharge pipe 220.

The opening of the reverse spray nozzle 330 is disposed spaced apart from the air tap 180 by a certain distance at the inflow end of the discharge pipe 220. The opening of the reverse spray nozzle 330 may have a trumpet shape in which the cross-section of opening is widened in the direction in which the washing water is sprayed so as to spray over a large area of the air tap 180.

The washing water sprayed in the reverse direction from the reverse spray nozzle 330 is sprayed at a higher pressure than the washing water flowing in the forward direction of the air tap 180.

The washing water is sprayed to the reverse spray nozzle 330 due to the operation of the pump and the washing water is supplied to the air jet generator 100 through the branch pipe 230 as long as the pump 40 is operated. Accordingly, the washing water sprayed in the reverse direction from the reverse spray nozzle 330 can pass through the air tap only when the washing water is sprayed at a higher pressure than the washing water flowing in the forward direction for the air tap 180.

Figure 7B:
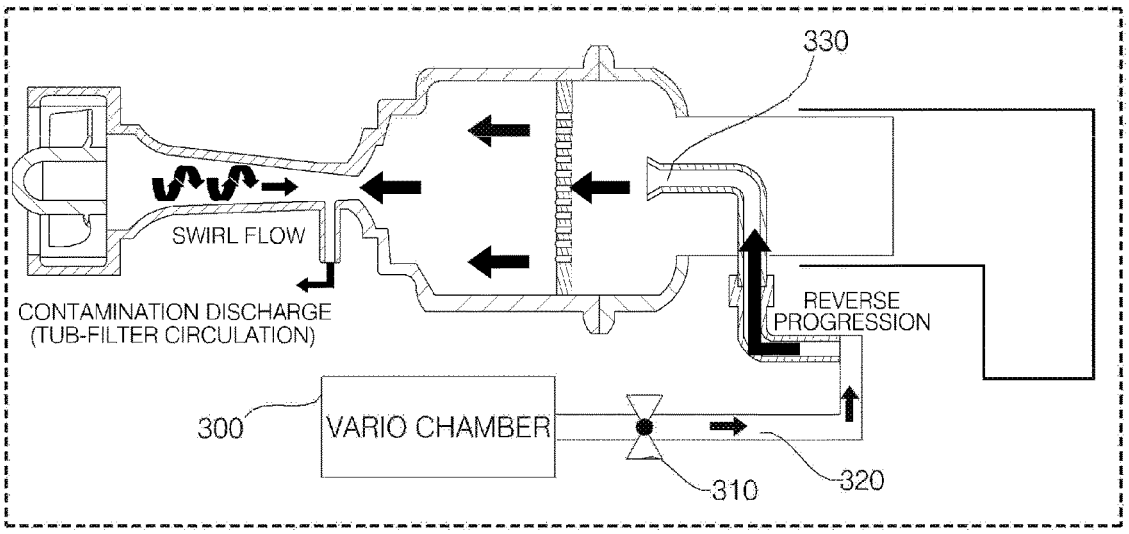
FIG. 7B is a diagram for explaining the flow of washing water inside an air jet generator when washing water is sprayed from a reverse spray nozzle.

Accordingly, referring to FIG. 7, when the washing water is not sprayed from the reverse spray nozzle 330, as shown in FIG. 7A, the washing water having the air bubbles that are formed by passing through the air jet generator 100 in the forward direction is discharged. As shown in FIG. 7B, when the washing water is sprayed from the reverse spray nozzle 330, the washing water is sprayed in a reverse direction from the reverse spray nozzle 330 and passes through the air tap 180 to be introduced into the air suction portion 140. In this process, the foreign matter clogged in the air tap 180 also escapes to the air suction portion 140.

The air suction portion 140 is disposed at a portion where the decompression of the decompression portion 120 is terminated. The air suction portion 140 is formed at a portion where the washing water flowing in the forward direction by the pump 40 at the decompression portion 120 and the washing water flowing in the reverse direction by the reverse spray nozzle 330 meet. Accordingly, as the washing water escapes to the air suction portion 140, the foreign matter also escapes.

The reverse spray nozzle 330 is connected to the vario chamber 300. The vario chamber 300 is an apparatus for selectively supplying washing water to the spray module 24, and supplies washing water to the reverse spray nozzle 330 by branching a part of the flow of the vario chamber 300. The vario chamber 300 and the reverse spray nozzle 330 are connected to the connection flow path 320. The connection flow path 320 includes a control valve 310 for opening and closing the flow path so that the washing water is sprayed to the reverse spray nozzle 330 when the control valve 310 of the connection flow path 320 is opened.

The pump 40 of the dishwasher 10 according to the present embodiment includes a motor (not shown) for driving the pump 40, and includes a current measuring unit (not shown) for measuring the current of the motor. The current measuring unit measures the current of the motor and detects the amount of change of a load. When the air tap is clogged with foreign matter, the amount of change of the load detected by the current measuring unit is increased.

When the amount of change of the load detected by the current measuring unit is increased, the control valve 310 is opened to supply the washing water to the reverse spray nozzle 330.

In the case where the air jet generator 100 is disposed inside the dishwasher 10, the air jet generator 100 is disposed on the lower lateral of the dishwasher 10. The air jet generator 100 is disposed in a lower portion of the dishwasher 10 in consideration of vibration and noise generated in the process of sucking air and forming air bubbles, and is disposed in the lateral close to the pump 40 so as to minimize the volume of flow path.

Referring to FIG. 8, the height (Oh) of the center of the discharge end of the pressing portion 130 from the lower end of the dishwasher 10 is disposed higher than the height (Ih) of the center of the inflow end of the decompression portion 130 from the lower end of the dishwasher 10. Since the center of the discharge end of the air crushing pipe 110 is disposed higher than the center of the inflow end, even if the pump stops operating, residual water remaining in the air jet generator 100 is discharged to the inflow pipe 210, so that the water is not accumulated inside the generator 100.

Figure 9:
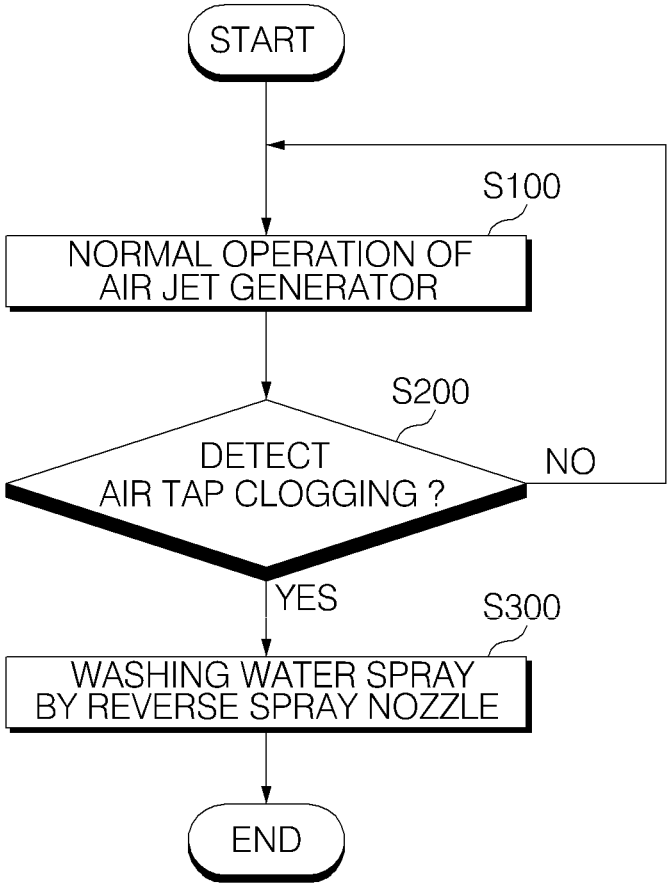
FIG. 9 is a flow chart showing a procedure of an air jet generator control method according to an embodiment of the present invention.

FIG. 9 is a flowchart showing a procedure of a method of removing foreign matter of an air jet generator according to an embodiment of the present invention.

Hereinafter, a control method of the air jet generator 100 according to the present embodiment will be described with reference to FIG. 9.

The air jet generator 100 performs a normal operation step S100 of injecting air into the washing water flowing in the forward direction and passing the washing water through the air tap to generate air bubbles in the washing water.

Some branched washing water is introduced into the air jet generator 100 by the operation of the pump 40. The washing water flows in the forward direction through the impeller, the decompression portion, the pressing portion, and the air tap of the air jet generator 100. The air is sucked into the air suction portion formed in the decompression portion, and the sucked air is crushed through the pressing portion and the air tap to form minute air bubbles.

The washing water containing the air bubbles is sent to the tub 18 and the sump 20 through the discharge pipe 220, and is pumped to the spray module so as to be used for washing dishes.

An air tap clogging detection step (S200) of detecting that the air tab is clogged is performed.

Since the washing water is reused through the sump, foreign matter generated in the process of washing the dishes may be introduced into the air jet generator 100. Such foreign matter cannot pass through the air tap forming a plurality of small holes and is clogged in the hole of the air tap, so that the air tap is clogged. When the air tap is clogged, the washing water cannot smoothly flow through the air tap, so that the air jet generator 100 cannot properly perform the function of generating air bubbles.

The clogging of the air tap 180 is determined by detecting the load variation by measuring the current of the motor operated in the pump 40. A current measuring unit (not shown) for measuring the current in the motor is provided, and the current measuring unit detects the load variation.

When the air tap is clogged, the washing water is not smoothly supplied to the air jet generator, so that the load variation of the motor is increased. The current measuring unit detects the clogging of the air tap, when detecting that the load variation of the motor is increased.

When the clogging of the air tap is detected, a reverse spray step (S300) of spraying the washing water in the reverse direction from the reverse spray nozzle is performed.

When the clogging of air tap is detected, the control valve 310 of the connection flow path 320 connected to the vario chamber 300 is opened. When the control valve 310 is opened, the washing water is sprayed to the reverse spray nozzle 330. The washing water sprayed from the reverse spray nozzle 330 is sprayed at a higher pressure than the washing water flowing in the air jet generator 100 in the forward direction. The washing water sprayed from the reverse spray nozzle passes through the air tap 180, removes foreign matter, and is discharged, together with the foreign matter, to the air suction portion 140.

Although the exemplary embodiments of the present invention have been disclosed for illustrative purposes, those skilled in the art will appreciate that various modifications, additions and substitutions are possible, without departing from the scope and spirit of the invention as disclosed in the accompanying claims. Accordingly, the scope of the present invention is not construed as being limited to the described embodiments but is defined by the appended claims as well as equivalents thereto.

| [Description of numeral] | |
|---|---|
| 10: dishwasher | 20: sump |
| 40: pump | 100: air jet generator |
| 110: air crushing pipe | 120: decompression portion |
| 130: pressing portion | 140: air suction portion |
| 170: impeller | 180: air tap |

-continued

| [Description of numeral] | |
|---|---|
| 210: inflow pipe | 300: vario chamber |
| 310: control valve | 320: connection flow path |
| 330: reverse spray nozzle | |

The invention claimed is:

1. A dishwasher comprising:

a tub configured to receive dishes;

a spray nozzle configured to spray washing water toward the dishes in the tub;

a sump configured to supply the washing water to the spray nozzle;

a pump configured to supply the washing water stored in the sump to the spray nozzle; and an air jet generator configured to receive a part of the washing water pumped from the pump and to generate an air bubble in the washing water, the air jet generator being configured to discharge the washing water including the air bubble to the sump, wherein the air jet generator comprises:

a decompression flow path configured to decrease a pressure of the washing water flowing in a forward direction in the air jet generator, an air flow path configured to receive air and to provide the air into the decompression flow path, a pressing flow path configured to increase the pressure of the washing water to crush the air introduced from the air flow path, an air tap that defines a plurality of holes configured to crush the air in the washing water received through the pressing flow path, and a reverse spray nozzle configured to spray the washing water toward the air tap in a reverse direction opposite to the forward direction.

2. The dishwasher of claim 1, wherein the air jet generator further comprises an impeller configured to apply centrifugal force to the washing water flowing in the forward direction.

3. The dishwasher of claim 1, wherein the washing water sprayed from the reverse spray nozzle flows into the air flow path.

4. The dishwasher of claim 1, wherein the air tap is disposed between the air flow path and the reverse spray nozzle.

5. The dishwasher of claim 1, wherein a pressure of washing water sprayed from the reverse spray nozzle in the reverse direction is higher than a pressure of washing water flowing in the forward direction through the air tap.

6. The dishwasher of claim 1, wherein the plurality of holes defined in the air tap have a slot shape that is elongated in a lateral direction crossing the forward direction.

7. The dishwasher of claim 1, further comprising a vario chamber configured to selectively supply the washing water to the spray nozzle, wherein the vario chamber is further configured to supply the washing water to the reverse spray nozzle.

8. The dishwasher of claim 7, further comprising:

a connection flow path configured to supply the washing water from the vario chamber to the reverse spray nozzle; and a control valve configured to open and close the connection flow path.

9. The dishwasher of claim 8, wherein the pump comprises:

a motor configured to drive the pump; and a current detector configured to detect a current applied to the motor, the current corresponding to a load applied to the motor, and wherein the control valve is configured to open and close based on variation of the current applied to the motor.

10. The dishwasher of claim 1, further comprising a tub connection flow path that connects the air flow path and the tub.

11. The dishwasher of claim 1, further comprising a discharge pipe configured to discharge the washing water from the air jet generator, wherein the reverse spray nozzle passes through one side of the discharge pipe, the reverse spray nozzle defining an opening that is disposed inside of the discharge pipe and that is opened toward the air tap.

12. The dishwasher of claim 1, wherein the air jet generator comprises an air crushing pipe that extends in a longitudinal direction, wherein the decompression flow path and the pressing flow path are portions of the air crushing pipe that are arranged in the longitudinal direction, and wherein the air flow path is located between the decompression flow path and the pressing flow path, and the air tap is located in the pressing flow path.

13. The dishwasher of claim 12, wherein the decompression flow path has a first flow path length, and the pressing flow path has a second flow path length that is different from the first flow path length, and wherein a ratio of a radius of an end of the pressing flow path with respect to the second flow path length is greater than a ratio of a radius of an end of the decompression flow path with respect to the first flow path length.

14. The dishwasher of claim 12, wherein a cross-sectional area of the decompression flow path decreases in the forward direction, and wherein a cross-sectional area of the pressing flow path increases in the forward direction.

15. The dishwasher of claim 12, wherein the reverse spray nozzle is disposed inside of the air crushing pipe and curved toward the air tap.

16. The dishwasher of claim 9, wherein the control valve is configured to, based on an increase of the current applied to the motor, open to supply the washing water to the reverse spray nozzle.

* * * * *